US006616189B2

(12) United States Patent
Raming

(10) Patent No.: US 6,616,189 B2
(45) Date of Patent: Sep. 9, 2003

(54) SEQUENTIALLY PLACED SHIPPING AND PACKING LABEL SYSTEM

(75) Inventor: Bruce A. Raming, Northbrook, IL (US)

(73) Assignee: Premier Print & Services Group, Inc., Chicago, IL (US)

( * ) Notice: Subject to any disclaimer, the term of this patent is extended or adjusted under 35 U.S.C. 154(b) by 0 days.

(21) Appl. No.: 09/877,421

(22) Filed: Jun. 8, 2001

(65) Prior Publication Data

US 2002/0193225 A1 Dec. 19, 2002

(51) Int. Cl.[7] ..... B42D 15/00; B31B 1/88; B31B 1/90

(52) U.S. Cl. ..... 283/81; 493/13; 493/187; 493/961

(58) Field of Search ..... 493/10, 13, 187, 493/188, 320, 961, 130, 141, 142; 53/131.2, 133.6, 136.1; 283/81, 94, 101, 103, 105

(56) References Cited

U.S. PATENT DOCUMENTS 2,690,104 A * 9/1954 Schwartz et al. ..... 101/35
3,817,157 A * 6/1974 Andresen, Jr. ..... 156/364
3,986,440 A * 10/1976 Macdonald et al. ..... 225/49
4,928,875 A 5/1990 Hutchinson
5,133,827 A * 7/1992 Ratermann ..... 156/360
5,242,365 A * 9/1993 Counts et al. ..... 493/188
5,289,972 A 3/1994 Sauerwine et al.
5,370,420 A 12/1994 Khatib et al.
5,425,823 A * 6/1995 Woodside, III ..... 156/277
5,427,029 A * 6/1995 Dumke ..... 101/484
5,639,125 A * 6/1997 Garrison ..... 283/101
5,653,472 A 8/1997 Huddleston et al.
5,700,998 A * 12/1997 Palti ..... 235/375
5,730,469 A 3/1998 Heimerdinger et al.
5,771,657 A * 6/1998 Lasher et al. ..... 53/131.4
5,931,098 A * 8/1999 Bates ..... 101/43
5,940,305 A * 8/1999 Wurz ..... 156/360
6,080,094 A * 6/2000 Dahlquist ..... 229/92.3
6,186,554 B1 * 2/2001 Raming ..... 283/81
6,213,518 B1 4/2001 Raming
6,273,986 B1 * 8/2001 Egan ..... 156/247
6,317,648 B1 * 11/2001 Sleep et al. ..... 53/500
6,325,877 B1 * 12/2001 Murphy ..... 156/358
6,419,782 B1 * 7/2002 Johnson et al. ..... 156/249
6,428,640 B1 * 8/2002 Stevens et al. ..... 156/215

* cited by examiner

*Primary Examiner*—Rinaldi I. Rada
*Assistant Examiner*—Paul Durand
(74) *Attorney, Agent, or Firm*—Hovey Williams LLP

(57) ABSTRACT

A system for providing a shipping label and a packing list on a container is provided which enables rapid and automated sequential application of a packing list and a shipping label to the container. The shipping label is configured complemental to the packing list whereby the packing list may first be adhered directly to the container and then the shipping label may be placed thereover. The shipping label may be applied over the packing list while the container moves continuously down a conveyor. The invention further includes an apparatus for sequentially applying the packing list and then the shipping label, and a method for applying the packing list and shipping label in registry.

34 Claims, 4 Drawing Sheets

SEQUENTIALLY PLACED SHIPPING AND PACKING LABEL SYSTEM

BACKGROUND OF THE INVENTION

1. Field of the Invention

The present invention concerns a two-part shipping and packing label system and method of making and applying the system which permits rapid placement of a shipping label over a packing list also provided as a label wherein both are applied to a substrate such as a container or the like. More particularly, it is concerned with a shipping and packing label system which may be sequentially applied to the container, wherein the shipping label is placed in registry over and around the packing list to conceal the latter until the shipping label is removed.

2. Description of the Prior Art

The emergence of mail order sales through catalogs and online retail sites has greatly expanded the shipment of products through the mail and commercial delivery services. The shipper must have a shipping label which provides an address to which the package is directed. In addition, a packing list must be provided for inventory control and tracking by the shipper and to provide the recipient a way to check whether the contents of the package match the order as placed. An inherent requirement is that the packing list be concealed from external view or be tamper evident to quickly show if someone has attempted to discover the contents of the shipping carton during delivery. One way of accomplishing this is to insert a packing list into the carton along with the products to be shipped, and then to apply a separate shipping label on the exterior of the carton. However, this is time consuming, requires substantial manual work by the shipper, and requires substantial efforts to coordinate the activities of the packing list placement with the application of the shipping label when the two steps are performed at remote locations. More significantly, this activity results in slowed processing of the order at the time of shipping, and prevents substantial economies to be achieved by increasing the speed of the conveyor during the shipping process.

An alternative method of applying shipping labels and packing lists involves the use of clear plastic pouches which are adhered to the outside of the carton with the statement "PACKING LIST ENCLOSED" printed thereon. The use of such plastic pouches enables the shipper to place the packing list and the shipping label on the exterior of the carton at the same time, but such pouches are expensive and still require the insertion of the packing list into the pouch, sealing of the pouch, placement of the pouch, and placement of the shipping label, which steps may involve further expense in the form of additional machines and or increased human labor, may reduce the speed of the shipping conveyor, and still has the shipping label printed and applied separately from the packing list which may result in separation of the two.

Recently, I have developed an improved shipping and packing label as shown in U.S. Pat. Nos. 6,186,554 and 6,213,518, the disclosures of which are incorporated herein by reference. This shipping and packing label represents a substantial improvement over the prior art and permits automated printing and application of the shipping label. However, these shipping and packing labels require duplex printers to apply printing to both sides of the form simultaneously. These printers are not readily available and thus currently inhibit the use of such forms by many shippers. Moreover, the requirement for a duplex printer prevents the use of current printers and label applicators from their use. The forms of the U.S. Pat. Nos. 6,186,554 and 6,213,518 patents are also designed for manual application to the container and do not lend themselves to high speed continuous application in an automated system which provides automated printing and application of the form in concert with automated matching of the shipping label to the container.

There has thus developed a need for a shipping label and packing list system which is economical, may be rapidly applied, and enables automated printing and application.

SUMMARY OF THE INVENTION

These and other objects have been achieved by the sequentially placed shipping label and packing list system of the present invention. That is to say, the present invention permits rapid printing and placement of packing lists and shipping labels using existing equipment which enables rapid movement of cartons along a shipping line, ensures confidentiality of the enclosed packing list, and permits automated printing and application to facilitate the matching of the shipping label and the packing list so that the contents of the package go to the intended recipient.

The system of the present invention includes two sequentially applied labels, one being a packing list which may be printed on one side with information corresponding to the contents of the carton and may be printed on its other side with masking indicia, and the second being a shipping label which is provided with adhesive in a pattern which, when applied to a substrate such as a face of a container, preferably covers and substantially surrounds the packing list. The packing list is preferably provided of a smaller dimension to permit good adhesion of the shipping label to the container and to provide a center portion having the printed information to fit within the perforations of the shipping label defining the removable center section, and has one or more preferably two lines of adhesive to ensure that the packing list remains in its desired location when applied to the carton. The packing list is preferably provided with two lines of weakness such as perforations which facilitate separation of the center portion carrying indicia identifying the contents from the adhesive strips. The shipping label is also provided with lines of weakness, such as perforations, which are parallel to the lines of weakness on the shipping label and facilitate removal of a center portion of the shipping label when a transverse tear strip is removed. The shipping label is applied to the container such as a carton or box so that its adhesive portions are exterior to at least part of the packing list, thereby surrounding and covering the packing list, and also ensuring good contact between the shipping label and the carton.

The sequentially applied shipping label and packing list system of the present invention thus represents a substantial advance over existing one-piece labels. The system of the present invention avoids the need for unique and dedicated duplex printers by using existing commercial application systems, and further avoids the necessity of folding one piece label and packing lists which are printed only on one side. The system hereof also facilitates higher speeds in automated processing of shipping orders. Each shipping label and its corresponding packing list may be uniquely printed with information corresponding to one order. The carton moves down the conveyor line in a sealed condition and carries a bar code, radio frequency identification tag, or other scannable identifying member. This scannable identifying member is then read by a bar code reader or the like to identify the particular carton and its contents and correlate that carton to correspond to information held in a computer memory regarding the contents and the desired recipient identification including the shipping address. The packing list is then applied to the carton as a label while the carton is moving using conventional printers and label applicators. A scanner then verifies the packing list by a bar code imprinted thereon before a second label applicator prints and applies the shipping label over the packing list label, all while the carton continues movement along the conveyor. As a result, an increased number of cartons, such as about 25 to 35 cartons per minute, may be processed through the shipping system and readied for shipment. Beneficially, the packing list and then the shipping label may be applied along one side of a container in a predetermined position, such as a multiple or fraction of inches from a leading edge and/or a bottom edge of a container, so that containers of various sizes exceeding a minimum in two dimensions may receive the labels without alteration or adjustment of the application system. For example, when the shipping labels and packing lists are applied to the sides of the containers as they moves along the conveyor, the containers need not be centered and may be of a wide variety of dimensions while still acceptably receiving the packing list and shipping label in sequence and in registry, ready for shipping.

These and other advantages will be readily appreciated by those skilled in the art with reference to the drawings and description which follow.

DESCRIPTION OF THE PREFERRED EMBODIMENT

Figure 5:
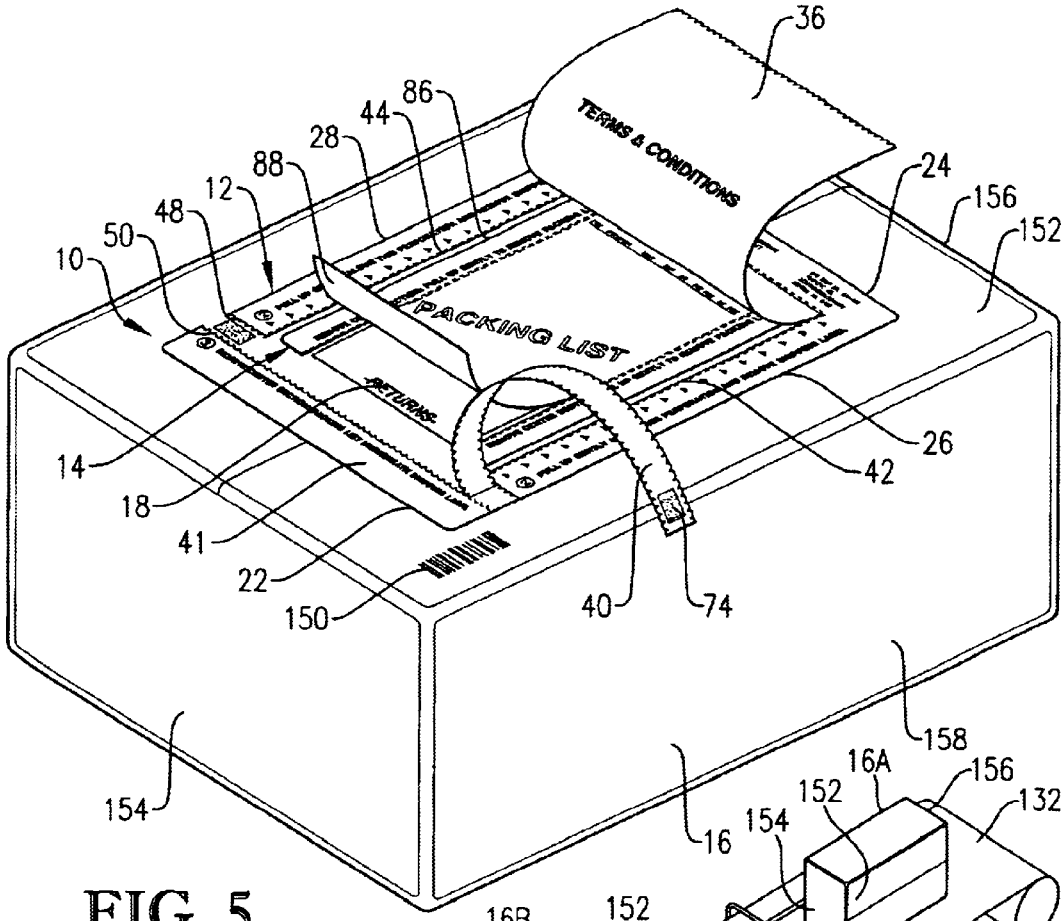
FIG. 5 is a perspective view of a container with the sequentially placed shipping and packing label system of the present invention showing the center section of the shipping label partially removed to permit viewing and removal of the packing list.

Referring now to the drawings, a sequentially applied shipping label and packing list system 10 in accordance with the present invention includes a shipping label 12 applied at a second station and a packing list 14 applied at a first station onto a container 16. Optionally, a return label 18 may be applied to the container prior to the packing list 14 as shown in FIG. 5. The shipping label 12 is applied in registry over and in surrounding relationship to the packing list 14, and similarly when the optional return label 18 is used, the packing list is applied over and in surrounding relationship to the return label 18, each being adhered to the container 16.

Figure 2:
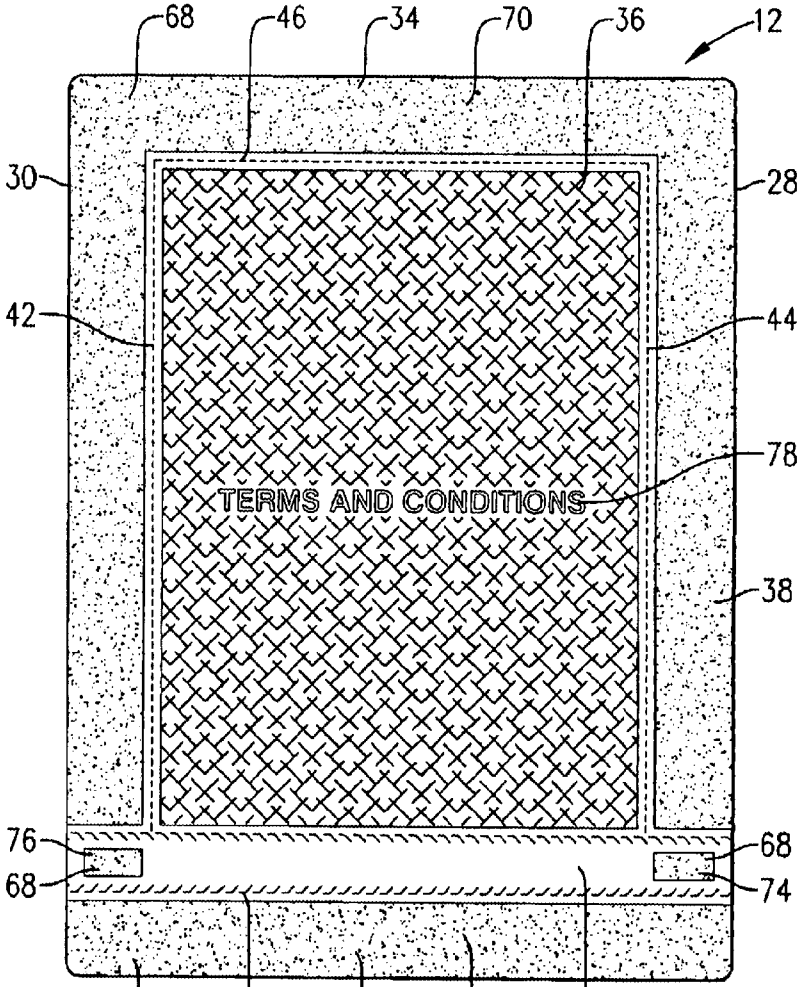
FIG. 2 is a plan view of the reverse side of the shipping label of FIG. 1 showing the positioning of adhesive applied to a surrounding border portion and the printing of masking indicia to prevent premature viewing of the packing list.
Figure 1:
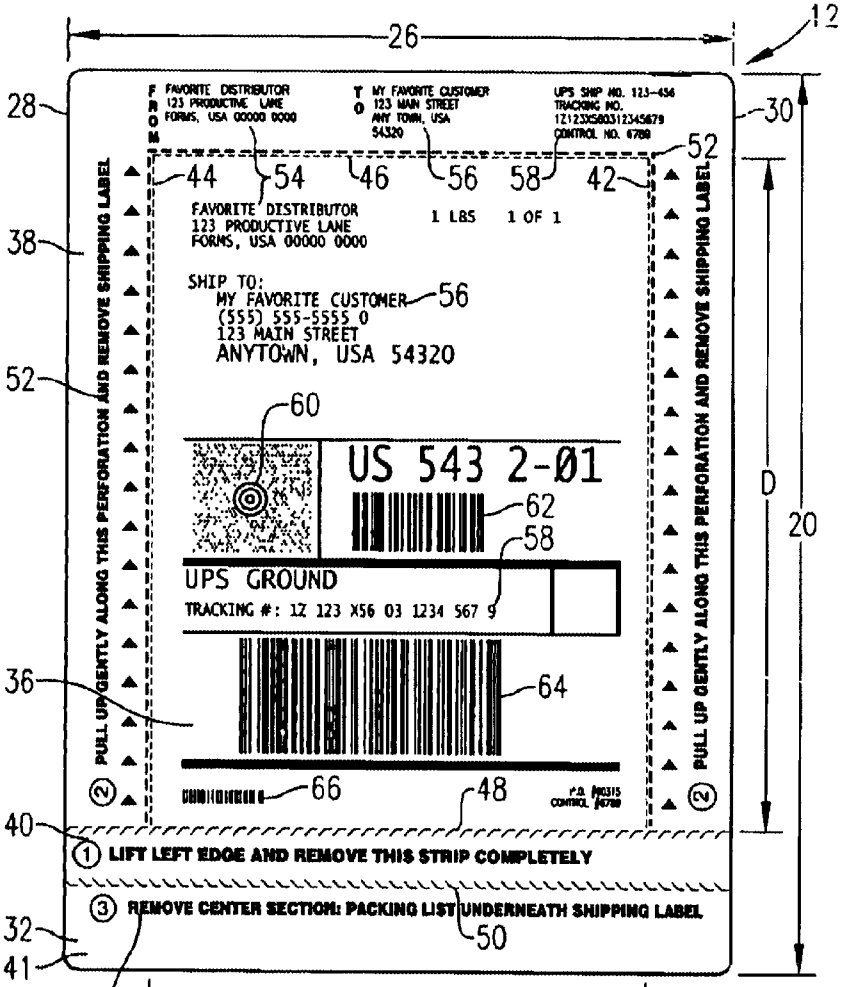
FIG. 1 is a plan view of the face side of a shipping label for use as a part of the sequentially placed shipping and packing label system of the present invention, showing the indicia printed thereon and the lines of weakness to permit removal of the center section for inspection of the packing list positioned therebeneath.

In greater detail, the shipping label 12 has a longitudinal dimension 20 extending between a leading edge 22 and a trailing edge 24, and a transverse dimension 26 extending between a first side edge 28 and a second side edge 30. The shipping label 12 has a face side 32 as shown in FIG. 1 and a reverse side 34 as shown in FIG. 2. The shipping label 12 includes a center section 36, a U-shaped border portion 38, a tear strip 40 and a base strip 41. Lines of weakness provided by scoring or more preferably by perforation aid in permitting removal of the center section 36 and include first line of weakness 42 and second line of weakness 44 both extending longitudinally and preferably parallel respectively proximate the first side edge 28 and the second side edge 30. A cross line of weakness 46 extends across the shipping label 12 proximate to and spaced from the leading edge 22 between the first line of weakness 42 and the second line of weakness 44, but preferably does not extend outboard of either first line 42 or second line 44. As used herein, "outboard" refers directionally toward the areas more proximate the edges 22, 24, 26 and 28, and "inboard" relates directionally to the inner or central part of the shipping label 12. The tear strip 40 is preferably defined by inboard transversely extending lines of weakness 48 and outboard transversely extending line of weakness 50, both of which are parallel to the cross line of weakness 46.

The shipping label 12 is provided with printed indicia including instructions 52, shipper identification 54, recipient identification 56, tracking and billing information 58, target indicia 60, and scannable indicia 62, 64 and 66 of the type well known such as UPC bar coding. The instructions 52 may include directions for use and line indicators which assist the recipient in identifying the lines of weakness 42, 44, 46, 48 and 50. The shipper identification 54, recipient information 56, and tracking and billing information 58 may be provided in optical character recognition typefont if it is desired that this information be electronically read and stored, or other typefont as desired, and may be reprinted in multiple different locations as desired by the sender. The target indicia 60 may be utilized by the machinery for printing and applying the shipping labels to aid in locating the printing or by the shipping carrier for identifying the labels on the container for locating and then scanning the information carried thereon. The scannable indicia 62 , 64 and 66 may be utilized during application of the labels for determining and verifying correct order and billing information and assisting in the routing of the container 16 both initially to the correct carrier and during shipment by the shipping carrier until delivery. Some of the indicia may be preprinted, such as the instructions 52, the shipper identification 54, and the target indicia 60, or this indicia as well as the remaining indicia may be variable printed for different shipping labels to correspond to a particular container 16.

Adhesive 68, such as pressure-sensitive adhesive, is applied to the reverse side 34 of the shipping label 12 to aid in adhering the shipping label 12 to the container 16. Adhesive 68 may be applied in a variety of different ways, such as by a spray head or the like, to predetermined locations on the reverse side 34, spaced or recessed about 1 mm from both the edges and the lines 3 of weakness to avoid bleeding of the adhesive beyond the edges and into the lines of weakness. One location is a U-shaped adhesive pattern 70 applied outboard of lines of weakness 42, 44 and 46 onto the reverse side 34 of the border portion 38 as shown in FIG. 2. A second location 72 of adhesive 68 is applied along the base strip 41. Adhesive 68 may also be applied on the reverse side 34 of the tear strip 40 in third location 74 proximate the first side edge 26 and at a fourth location 76 proximate the second side edge 26 as shown in FIG. 2. Masking indicia 78 may be preprinted prior to application of the adhesive, such as by grey ink or reverse printing, on the reverse side 34 of the center section 36 to inhibit premature viewing of the packing list 14.

Figure 4:
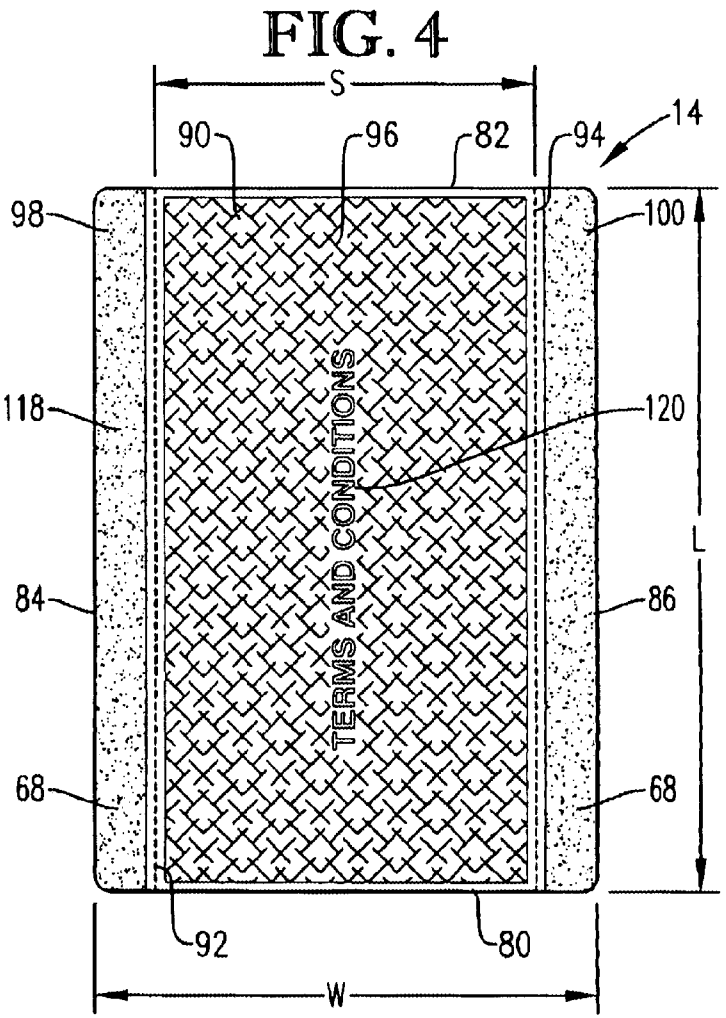
FIG. 4 is a plan view of the back side of the packing list of FIG. 3 showing the lines of weakness and the application of adhesive to the retaining strips.
Figure 3:
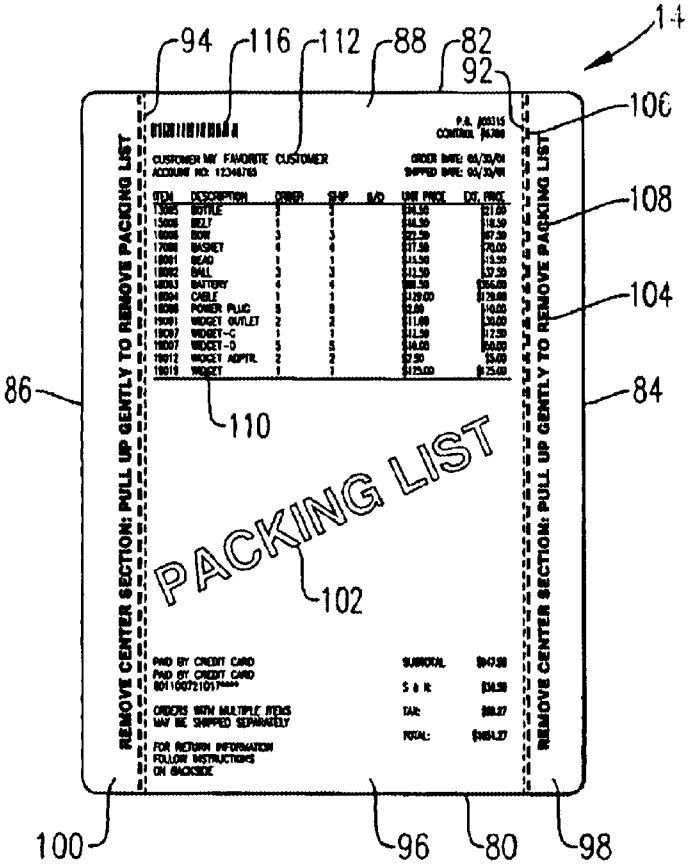
FIG. 3 is a plan view of the front side of a packing list for initial attachment to a container prior to application of the shipping label and used as a part of the sequentially placed shipping and packing label system of the present invention showing the indicia printed thereon and the lines of weakness for permitting removal of center portion from two adjacent retaining strips.

The packing list 14 is sized and positioned on the container complemental to the shipping label 12 and preferably to nest therein. The packing list 14 has a length L which extends between a leading margin 80 and a trailing margin 82, and a width W which extends between a first side margin 84 and a second side margin 86. The length of the packing list 12 is less than the longitudinal dimension 20 of the shipping label 12 and also less than the longitudinal distance D between the cross line of weakness 46 and the inboard transverse line of weakness 48. The width W of the packing list 12 is less than the transverse dimension 26 of the shipping label 12 and also less than the transverse distance T between the first line of weakness 42 and the second line of weakness 44 of the shipping label 12. The packing list 14 includes a front side 88 shown in FIG. 3 and a back side 90 shown in FIG. 4. Two longitudinally extending packing list lines of weakness 92 and 94 are preferably parallel and formed by scoring or, more preferably, perforations. The lines of weakness 92 and 94 extend between the leading margin 80 and the trailing margin 82 and divide the packing list 14 into a center portion 96 having a transverse width S and two retaining strips 98 and 100. The transverse width S is less than the transverse distance T. The front side 88 may be printed with indicia 102 including instructional indicia 104 such as location lines 106 in substantial registry with lines of weakness 92 and 94 and directions 108, content indicia 110 corresponding to the contents of the container 18 and cost information, identification indicia 112 to identify the customer name and account number, tracking and control indicia 114 setting forth information such as the purchase order, order control number, order and shipping date, and scannable indicia 116 such as a UPC bar code which enables correlation between the shipping label 12 and the packing list 14. Preferably, the scannable indicia 116 is the same as, or corresponds to, scannable indicia 66 of shipping label 12.

The back side 90 of the packing list includes first and second regions 118, 120 of adhesive 68 such as pressure-sensitive adhesive applied between the side margins 84 and 86 and the lines of weakness 92 and 94 most proximate thereto. The first and second regions 118, 120 of adhesive are preferably recessed about 1 mm from the margins 80, 82, 84 and 86 and also from the lines of weakness 92 and 94. This leaves the back side 90 of center portion 96 free of adhesive 68. The center portion 96 may thus be separated from the container 18 while the retaining strips 98 and 100 remain adhered to the container. The back side 90 of the center portion 96 may be preprinted with terms and conditions or other printing 122 prior to application of the adhesive on the retaining strips, which further inhibits premature viewing of the packing list content indicia 110.

Both the shipping label 12 and the packing list 14 are preferably initially preprinted with instructional indicia and, as desired, masking indicia. The adhesive 68 is then applied on the rear side and the back side, respectively, of the shipping label 12 and the packing list 14, or to respective liners 124 and 126, shown in FIG. 6. The shipping label 12 and the packing list 14 are then applied to and mated with their respective liners 124 and 126, with the liners being provided with a release coating of silicone or the like, as is conventional, whereby the adhesive remains with the shipping label 12 and packing list 14 upon their removal from their respective liners. The liners 124 and 126 also advantageously serve to assist in advancing their respective shipping labels and packing lists through the printing and applicating machinery, as will be explained further herein. A plurality of such shipping labels 12 and packing lists 14 are mated with the continuous liners, such that the liners and their shipping labels or packing lists are provided on rolls or the like for feeding into the printing and applicating machinery.

Optionally, a return label 18 may be provided as a part of the system hereof, the return label 18 having smaller transverse and longitudinal dimensions than the center portion 96. The return label 18 may be provided to facilitate return of merchandise and includes the address indicia of the shipper and preferably bar code indicia corresponding to scannable indicia 116. The return label 18 may be provided with pressure sensitive adhesive 68 on its back side and may include a liner with one side covered with a release coating facing the back side of the return label 18 and another side covered with adhesive for application and adhering to the container 16.

Figure 7:
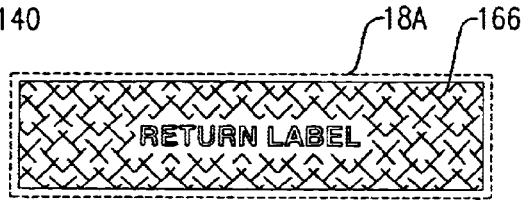
FIG. 7 is a plan view of a return label showing the back side thereof which may be provided as a part of a shipping label center section.
Figure 9:
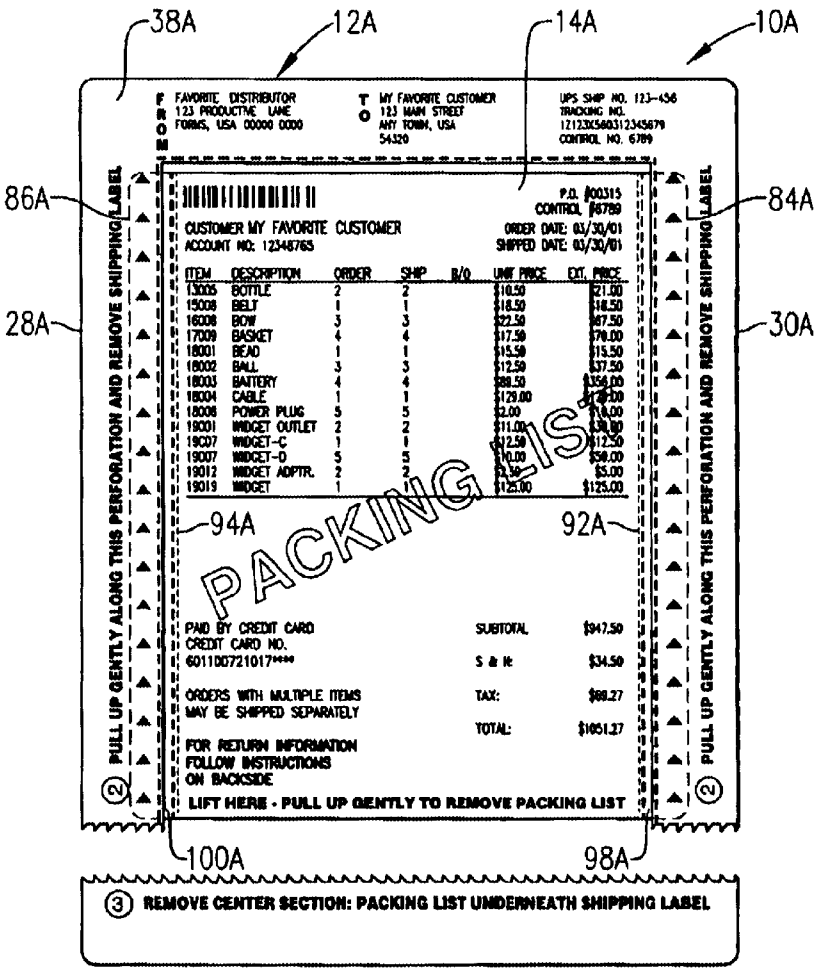
FIG. 9 is a plan view of the system of FIG. 8 showing the center section of the shipping label removed to show the center portion of the packing list centered therein and the side margins of the packing list in phantom lines and positioned beneath the U-shaped border portion.
Figure 8:
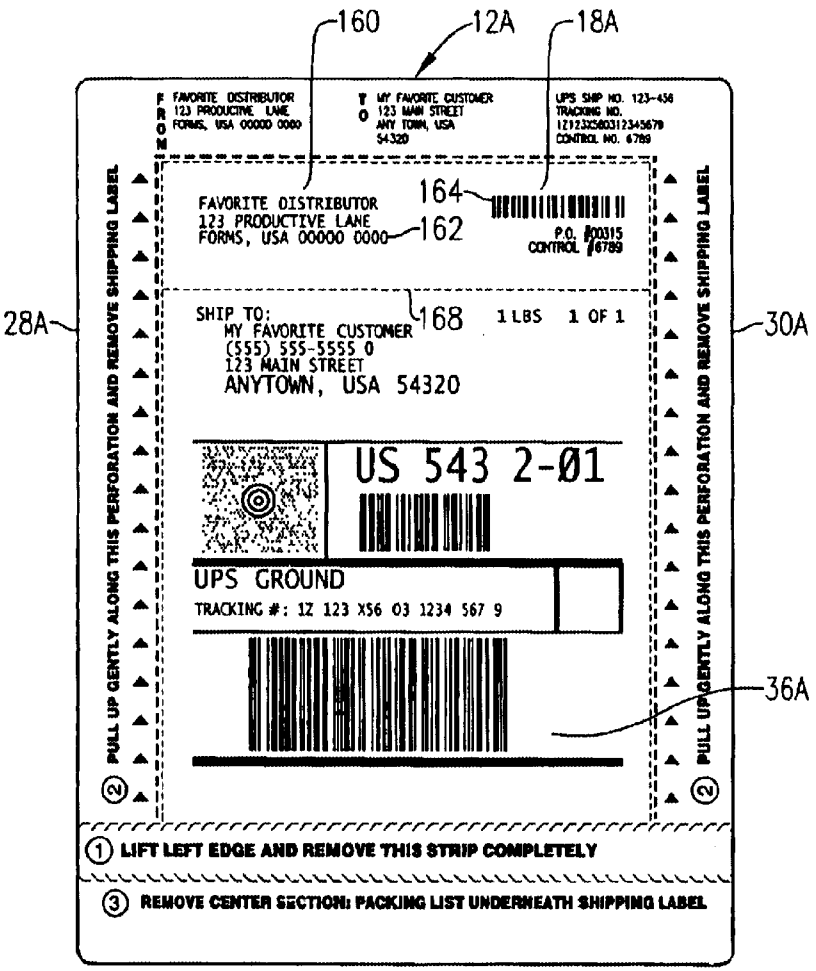
FIG. 8 is a plan view of an alternate embodiment of the shipping and packing label system hereof, wherein the shipping label center section includes an additional transverse line of weakness to provide a detachable return label as shown in FIG. 7 and the packing list extends laterally beyond the longitudinally extending first and second lines of weakness defining the center section of the shipping label.

An alternate embodiment of the sequentially applied shipping and packing label system 10A is shown in FIGS. 7,8 and 9. In this regard, the shipping label 12A shown in FIGS. 8 and 9 is substantially the same as the shipping label 12 described above but includes an integrated return label 18A with a front side 160 including return label indicia 162 such as a bar code indicia 164 corresponding to scannable indicia 116, purchase order number, control order number, return address and may also include a returned goods authorization code number. The integrated return label 18A also includes a back side 166 as shown in FIG. 7 when detached from the shipping label 12A center section, which may be reverse printed with masking indicia or the like and identifies the return label as such. Like the remainder of the center section 36A, shown removed from the shipping label 12A in FIG. 9, the back side 166 of the return label 18A is not provided with adhesive, and thus the return label is taped to the container returning the merchandise if used. The return label 18A is defined by an additional transverse line of weakness 168 provided by scoring or more preferably perforations to permit separation of the return label 18A from the remainder of the center section 36A of the shipping label 12A. In addition, the packing list 14A of the system 10A is wider between its side edges 84A and 86A permitting a greater width W and a greater transverse dimension S between longitudinally extending lines of weakness 92A and 94A so that center portion 96A is also wider than center portion 96 of packing list 14. However, the width W is still less than the transverse dimension 26A of the shipping label 12A, such that at least apart of the adhesively backed U-shaped border portion 38A adheres directly to the underlying container along the side edges 28A and 30A while overlapping and adhering to the retaining strips 98A and 100A of the packing list 14A.

Figure 6:
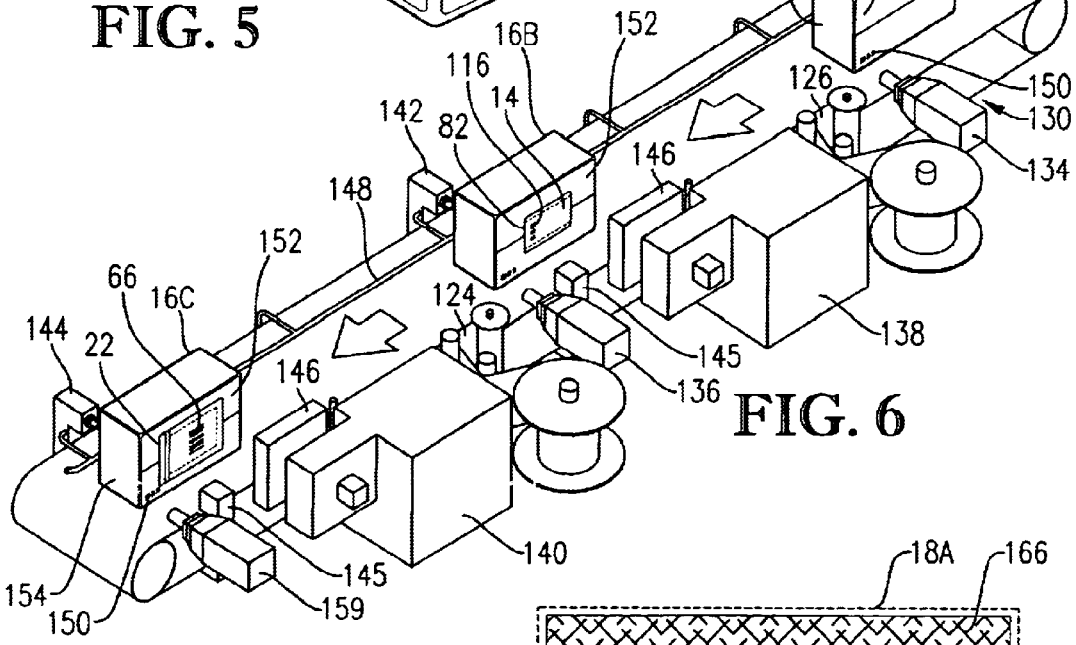
FIG. 6 is a diagrammatic view of the process of the sequential application of a packing list and a shipping label in registry on a container in accordance with the present invention.

In order to sequentially apply the system 10 or 10A including the shipping label 12 or 12A and the packing list 14 or 14A to a container 16 in an automated rapid sequence, a processing assembly 130 is provided as shown generally in FIG. 6. The processing assembly 130 includes a belt-type conveyor 132 for carrying the containers 16 therealong although other types of conveyors such as roller conveyors may be used, first scanner 134 and optional second scanner 136 for reading scannable indicia on the containers 16, first and second printing and applicating machines 138 and 140, and position indicators 142 and 144, such as touch fingers or more preferably electric eyes, for detecting the passage of the containers 16 therepast. The position indicators 142 and 144 may include reflectors 145 or light beam generators opposite thereto as is well known to those skilled in the art. The printing and applicating machines may be, for example, Label-Aire Model 2138 print and apply machines from Label-Aire, Inc. of Fullerton, Calif. equipped with a Zebra Pax 170 Print Engine which include an applicator arm 146 which reciprocates toward and away from the containers as they move along the conveyor 132. A low-profile bumper rail 148 may be provided at desired locations along the conveyor 132 to resist lateral movement of the containers 132 opposite the applicator arms 146 if necessary without interfering with the position indicators and scanners. A controller (not shown) such as a computer with a central processing unit and computer memory is operably connected to the motor of the conveyor, the position indicators 142 and 144, the scanners 134 and 136, and printing and applicating machines 138 and 140.

In use, the containers 16 are initially filled with the contents of an order to a seller or other supplier, and then sealed. The containers 16 are also supplied with a unique scannable indicia 150 such as a UPC bar code on a label corresponding to the order. The scannable indicia 150 preferably is the same or corresponds to the indicia 66 and 116, and is applied to a face 152 of the container 16 which is oriented toward the scanners 134 and 136 when the container 16 is placed on the conveyor 132. Information corresponding to the indicia 150 for each container 16 in positions 16*a,* 16*b* and 16*c* as shown in FIG. 6 is then held in the computer memory. When the containers are placed on the conveyor 132, they are moved therealong until the scannable indicia 150 is detected by the scanner 134. The scanner 134 reads the scannable indicia 150 and communicates a signal corresponding to the indicia 150 to the controller which identifies the order corresponding to the indicia 150 in its memory. The controller then transmits a signal to the first printing and applicating machine 138 instructing it to advance the liner 126 corresponding to the packing list and to print the indicia not already preprinted on the packing list 14 and which corresponds to the order and the indicia 150 for container in position 16*a*. The speed of the conveyor 132 may be preset or variable; if the speed is variable, information corresponding to the speed of the conveyor 132 is communicated to the controller and the arm 146 is actuated dependent on the speed of the conveyor 132 and detection of a front end 154 of the container. When the speed of the conveyor 132 is fixed, the arm 146 is actuated after a predetermined time delay period once the front end of the container 16 is detected by the position indicator 142. When the position indicator 142 detects the front end 154 of the container in position 16*b,* it communicates a signal to the printing and applicating machine 138 to extend the arm 146 and apply the packing list 14 to the container 16. It is especially advantageous that the packing list 14 (and subsequently the shipping label 12) be applied on the side of the container 16 as it moves along the conveyor 132. In this way, the printing and applicating machines 138 and 140 may be positioned at a fixed location so as to apply the packing list and then the shipping label in preselected locations. For example, because the bottom end 158 of the container rests on the conveyor belt at a known height and the front end of the container is detected by the sensors, the packing list is applied at a preselected location which is spaced from the bottom end 158 and the front end 154 sufficiently that the shipping label 12 may be positioned thereover. In this instance, the shipping label 12 is then applied so that its surrounding edge need be only slightly above (for example, about ½ inch or more) the bottom end 158 of the container (as oriented as shown in FIG. 6) and only slightly behind (for example, about ½ inch or more) the front end 154 of the container 16 as it moves along the conveyor. This ensures that so long as the containers 16 meet minimum height and length requirements (as oriented as shown in FIG. 6) only slightly greater than the transverse and longitudinal dimensions of the shipping label 12, the shipping label and packing list system 10 hereof may be placed on a wide variety of dimensions of containers without the need for adjustment, all with the shipping label 12 being in registry with the packing list 14.

After the packing list 14 is applied, the conveyor 132 advances the container to position 16*c*. While so moving, the container passes the second scanner 136 when used and the position indicator 142 detects the back end 156 of the container. The second scanner 136 may be positioned to read the scannable indicia 116 on the packing list 12 to verify that the packing list 14 which has been printed and applied to the container 16 matches the order corresponding to indicia 150 and the information in the memory of the controller, or to read the indicia 150 on the container. If not correct, the controller may generate an error or alarm signal. Alternatively, the second scanner 136 may be omitted and the signal generated by the first scanner 134 is communicated via the controller to the second printing and applicating machine 140 to advance the liner 124 and to print the indicia not already preprinted on the shipping label 12. The shipping label 12 is then ready to be applied to the container 16 once the second position indicator 144 detects the front end of the container 16 when it reaches the position 16*c*. As in the case of the packing list 14, the speed of the conveyor 132 may be preset or variable; if the speed is variable, information corresponding to the speed of the conveyor 132 is communicated to the controller and the arm 146 of the second print and applicating machine 140 is actuated dependent on the speed of the conveyor 132 and detection of a front end 154 of the container. When the speed of the conveyor 132 is fixed, the arm 146 of the second print and applicating machine 140 is actuated after a predetermined period once the front end of the container 16 is detected by the position indicator 144. When the position indicator 144 detects the front end 154 of the container in position 16*c*, it communicates a signal to the printing and applicating machine 140 to extend the arm 146 and apply the shipping label 12 to the container 16. Based on the preset locations of the printing and applicating machines 138 and 140 to their respective position indicators 142 and 144, the shipping label 12 may be applied with precision whereby the lines of weakness 42, 44, 46 and 48 are outboard of the margins 80, 82, 84 and 86 of the packing list 12 therebeneath. After application of the shipping label 12, the shipping label covers the packing list 14, but lies in registry with the packing list so that each adheres independently to the container without interference from the other, and so that removal of the center section of the shipping label 12 immediately reveals the packing list 14. The system hereof is also tamper-evident, in that the adhesive of the shipping label 12 substantially surrounds at least the center portion of the packing list 14 requiring tearing of the tear strip to gain access to information regarding the contents of the container 16. The shipping label 12 also includes sufficient space on its front side to enable printing of indicia regarding billing and tracking codes and shipping billing information as well as the identification of the recipient and shipper so that after application of the system 10, the carrier has access to all needed information to permit handling and transport of the container 16. An optional final scanner 159 similar to scanners 134 and 136 may be provided after the shipping label 12 is adhered to the container to verify that the correct shipping label with the correct indicia has been applied.

The application of the system 10A including the packing list 14A and the shipping label 12A is in all respects the same as described above, except that because of the greater width W of the packing list 14A, the shipping label 14A applied over the packing list 14A extends onto the retaining strips 98A and 100A. Thus, the adhesively backed U-shaped border portion 38A extends across the side margins 84A and 86A to adhere both to the container and to the retaining strips 98A and 100A. However, the center portion 96A is positioned between the first and second longitudinally extending lines of weakness 42A and 44A and thus readily accessible upon removal of the center section 36A.

When the container 16 is delivered with the system 10 applied thereon, the recipient can verify the information regarding the sender and the recipient visually from the shipping label 12. If correct, the recipient may tear away the tear strip 40 as shown in FIG. 5. This then enables the recipient to readily tear away the center section 36 along first and second lines of weakness 42 and 44 as well as cross line of weakness 46 if desired. The packing list 14 is then revealed and may be examined. If the recipient desires, the center portion of the packing list 14 may be torn away along lines of weakness 92 and 94 and retained for the recipient's records. If desired, the system 10 may include an optional return label 18 which is revealed when the center portion is removed, whereby the container may be returned to the sender with a preaddressed label. When the system 10A is used, if the recipient desires to return some or all of the merchandise, he or she need only tear away the return label 18A provided on the center section 36A and tape it to the container to be returned.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, radio frequency identification tags may be substituted for the bar codes as the scannable indicia whereby the radio frequency identification tags can generate a signal by a battery contained therein or in response to an interrogation signal when the radio frequency identification tag is provided as a transponder. In addition, the return label could be incorporated into the packing list, such that a bridge section with adhesive backing spans the retaining strips and remains adhered to the container after removal of the center section of the shipping label and the center portion of the packing list.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A plural-ply, sheet material attachment for a container wherein the attachment is produced by a process that includes the sequential steps of providing a first ply of sheet material, attaching the first ply of the sheet material to the container, and thereafter placing a second ply of sheet material at least partially atop the first ply, each ply being provided with an adhesive, the adhesive on the first ply being disposed for adhering the first ply to the container and the adhesive on the second ply being disposed for adhering the second ply to one of the container alone and both the first ply and the container, the first ply having a central portion that is devoid of adhesive to avoid adhering to the container, the second ply having a central portion that overlies the central portion of the first ply and is devoid of adhesive to avoid adhering to the central portion of the first ply, said central portion of the second ply being removable from remaining portions of the second ply to expose the central portion of the first ply.

2. A plural ply, sheet material attachment as claimed in claim 1, wherein each of said plies is provided with indicia thereon.

3. A plural ply, sheet material attachment as claimed in claim 2, wherein the indicia on each ply includes information unique to a recipient of the container.

4. A plural ply, sheet material attachment as claimed in claim 3, wherein the indicia on each ply includes information unique to a sender of the container.

5. A plural ply, sheet material attachment as claimed in claim 2, wherein the indicia on each ply includes information unique to a sender of the container.

6. A plural ply, sheet material attachment as claimed in claim 1, wherein the adhesive on the second ply is disposed for adhering the second ply to the container.

7. An attachment as claimed in claim 1, said adhesive on the first and second plies comprising a pressure-sensitive adhesive.

8. An attachment as claimed in claim 1, said second ply including a removable transverse tear strip extending entirely across the second ply and across one end of the central portion of the second ply, said second ply having lines of weakness cooperating with said tear strip to define the boundaries of the central portion of the second and to facilitate removal of the central portion of the second ply from the container after the tear strip has been removed.

9. A method for sequentially applying a packing list and a shipping label to a container comprising the steps of:

providing a conveyor for conveying containers along a path from an upstream to a downstream location, a first sensor positioned adjacent the conveyor, a first label applicator positioned adjacent the conveyor and operatively coupled to said first sensor, a second sensor positioned adjacent the conveyor and located downstream from the first sensor, and a second label applicator positioned adjacent the conveyor and located downstream from the first label application station;

continuously moving a container along the conveyor;

sensing the position of the container by the first sensor as the container moves along the conveyor past the first sensor;

operatively communicating a signal from the first sensor to the first label applicator indicative of the position of the container;

actuating the first label applicator responsive to the signal communicated to the first label applicator to adhesively apply a packing list to the container as it moves along the conveyor;

sensing the position of the container by the second sensor as the container moves along the conveyor;

operatively communicating a signal from the second sensor to the second label applicator indicative of the position of the container; and actuating the second label actuator responsive to the signal communicated to the second label applicator to adhesively apply a shipping label to the container over and in registry with the packing list previously adhered to the container, said packing list being adhered to the container but having a central portion that is unadhered to the container, said central portion having indicia printed thereon corresponding to the contents of the container, said shipping label being adhered to one of the container alone and both the packing list and the container, said shipping label having a central portion that overlies the central portion of the packing list in covering relationship to the indicia corresponding to the contents printed thereon, said actuating of the second label applicator including applying the shipping label such that the central portion of the shipping label is positioned in registry with and unadhered to the central portion of the packing list and being removable from remaining portions of the shipping label to permit exposing the central portion of the packing list when the central portion of the shipping label is removed from the container.

10. A method as set forth in claim 9, wherein said shipping label includes a face side, a rear side, a border portion having adhesive thereon, and a center portion without adhesive on the rear side and said actuating step includes applying the shipping label to the container such that the border portion is outboard of and does not engage the packing list.

11. A method as set forth in claim 10, including providing a first scanner positioned upstream of the first label applicator and scannable indicia on the container corresponding to the intended recipient and contents of the container, and further including the step of scanning the scannable indicia by the first scanner.

12. A method as set forth in claim 11, wherein said first label applicator includes a printer, and including the steps of operatively communicating a signal from the first scanner to the first label applicator corresponding to the intended recipient and contents of the container and printing indicia indicative of the intended recipient and contents of the container on the packing list by the first label applicator prior to applying the packing list to the container.

13. A method as set forth in claim 12, wherein said second label applicator includes a printer, and including the step of printing indicia corresponding to the identification of the intended recipient on the shipping label by the second label applicator prior to applying the shipping label to the container.

14. A method as set forth in claim 13, including providing a second scanner downstream from said first label applicator and upstream from said second label applicator, and including the step of scanning indicia on one of said packing list and said container and operatively communicating a signal corresponding to the intended recipient to said second label applicator and printing indicia responsive to the receipt of the signal from the second scanner.

15. A method as set forth in claim 14, wherein the first label applicator prints scannable indicia on the packing list prior to applying the packing list to the container, and wherein the second scanner scans the scannable indicia on the packing list and operatively communicates a signal corresponding to the scannable indicia scanned on the packing list to the second label applicator for printing the indicia on the shipping label.

16. A method as set forth in claims 9, wherein the container includes a front end oriented in a downstream direction on the conveyor and a bottom end in engagement with the conveyor and wherein the first sensor detects the front end of the container as it moves therepast and the first label applicator applies the packing list to the container at a predetermined location on the container relative to the sensed front end and the bottom end.

17. A method as set forth in claim 16, wherein the second sensor detects the front end of the container as it moves therepast and the second label applicator applies the shipping label over the packing list at a predetermined location on the container relative to the sensed front end and the bottom end.

18. A method as claimed in claim 9, said shipping label being adhered using a pressure-sensitive adhesive.

19. A method as claimed in claim 9, said shipping label including a removable transverse tear strip extending entirely across the shipping label and across one end of the central portion of the shipping label, said shipping label having lines of weakness cooperating with said tear strip to define the boundaries of the unadhered central portion of the shipping label and to facilitate removal of the central portion of the shipping label from the container after the tear strip has been removed.

20. A method of applying plural-ply attachment of sheet materials to a container comprising the sequential steps of:

using a first printing and applying machine to print information on a front side of a first ply of sheet material and to apply a back side of the first ply to a container; and using a second printing and applying machine to print information on a face side of a second ply of sheet material and to apply a reverse side of the second ply to a container having a first ply previously applied thereto, said second ply being placed at least partially atop the first ply, each of said plies containing information that is distinct from the information contained on the other ply but is related to the information contained on the other ply in a predetermined manner, said first ply being affixed to the container but having a central portion that is unaffixed to the container, said second ply being affixed to one of the container alone and both the first ply and the container, said second ply having a central portion that overlies the central portion of the first ply, said reverse side of the central portion of the second ply being positioned in registry with and over the front side of the central portion of the first ply such that the central portion of the second ply is unaffixed to the central portion of the first ply and being removable from remaining portions of the second ply to permit exposing the central portion of the first ply when the central portion of the second ply is removed from the container.

21. A method as claimed in claim 20, wherein said second ply entirely covers the first ply.

22. A method as claimed in claim 20, wherein the information applied to both plies includes information that is unique to a sender of the container.

23. A method as claimed in claim 22, wherein the information applied to both plies includes information that is unique to a recipient of the container.

24. A method as claimed in claim 20, wherein the information applied to both plies includes information that is unique to a recipient of the container.

25. A method as claimed in claim 20, said second ply being affixed using a pressure-sensitive adhesive.

26. A method as claimed in claim 20, said second ply including a removable transverse tear strip extending entirely across the second ply and across one end of the central portion of the second ply, said second ply having lines of weakness cooperating with said tear strip to define the boundaries of the unaffixed central portion of the second ply and to facilitate removal of the central portion of the second ply from the container after the tear strip has been removed.

27. Apparatus for sequentially applying a shipping label and a packing list in registry on a container, comprising:

a conveyor adapted to receive thereon a container and advance the container therealong from a first upstream location to a second downstream location;

a first sensor positioned adjacent the conveyor and oriented to detect the movement of a container therepast;

a first label application station positioned adjacent the conveyor and operatively coupled to said first sensor, said first station including a print and application machine for printing and applying a first label having a front side and a back side to a container detected by the first sensor during movement of a container therepast, the print and application machine applying the back side of the label to the container and printing on the front side of the label;

a second sensor positioned adjacent the conveyor and downstream from the first label application station and oriented to detect the movement of a container therepast;

a second label application station positioned adjacent the conveyor and downstream from the first label application station, said second label application station being operatively coupled to said second sensor and including a print and application machine for printing and applying a second label having a face side and a reverse side to a container detected by the second sensor during movement of a container therepast, said second label application station being positioned for applying the reverse side of the second label to the container in a preselected position over and relative to the first label and printing on said face side, said first label being affixed to the container but having a central portion that is unaffixed to the container, said second label being affixed to one of the container alone and both the first label and the container, said second label having a central portion that overlies the central portion of the first label, said central portion of the second label being unaffixed to the central portion of the first label without adhesive connecting the reverse side to the front side in the area of the central portion and being removable from remaining portions of the second label to permit exposing the central portion of the first label when the central portion of the second label is removed from the container.

28. The apparatus of claim 27, further including a scanner positioned adjacent said conveyor upstream from said second label application station and oriented to read a scannable indicia on a container moving along said conveyor and operatively connected to said second label application station for communicating a signal corresponding to said scannable indicia to said second label application station and printing a label with information corresponding to the scannable indicia.

29. The apparatus of claim 28, wherein said scanner is an optical scanner.

30. The apparatus of claim 27, further including a scanner positioned adjacent said conveyor upstream from said first label application station and oriented to read a scannable indicia on a conveyor moving along said conveyor and operatively connected to said first label application station for communicating a signal corresponding to said scannable indicia to said first label application station and printing a label with information corresponding to the scannable indicia.

31. The apparatus of claim 30, wherein said scanner is an optical scanner.

32. The apparatus of claim 27, wherein each of said first and second label application stations includes a reciprocating arm for applying a label to a container moving therepast, and further including a rail opposite each of said label application stations and adjacent said conveyor for resisting shifting of a container in a direction transverse to its downstream movement as a result of engagement of the container by the arm.

33. Apparatus as claimed in claim 27, said second label being affixed using a pressure-sensitive adhesive.

34. Apparatus as claimed in claim 27, said second label including a removable transverse tear strip extending entirely across the second label and across one end of the central portion of the second label, said second label having lines of weakness cooperating with said tear strip to define the boundaries of the unaffixed central portion of the second label and to facilitate removal of the central portion of the second label from the container after the tear strip has been removed.

* * * * *